United States Patent [19]

Hansen

[11] 4,044,710

[45] Aug. 30, 1977

[54] INVENTORY CONTROL BOARD

[76] Inventor: Richard Hansen, Rte. No. 1 - 9826 Sherman Road, Cedarburg, Wis. 53012

[21] Appl. No.: 675,314

[22] Filed: Apr. 9, 1976

[51] Int. Cl.[2] ..... G09F 11/24

[52] U.S. Cl. ..... 116/133; 40/65; 40/77.4

[58] Field of Search ..... 116/130, 134, 131, 133; 40/68, 77.4, 16 R, 64 R, 65

[56] References Cited

U.S. PATENT DOCUMENTS

| | | | |
|---|---|---|---|
| 1,235,924 | 8/1917 | Read | 116/133 X |
| 1,851,145 | 3/1932 | Auth | 40/16 X |
| 1,912,418 | 6/1933 | Vehling et al. | 116/131 |
| 2,503,255 | 4/1950 | George | 40/77.4 |
| 3,305,958 | 2/1967 | Price, Jr. | 116/133 |

*Primary Examiner*—Richard C. Queisser
*Assistant Examiner*—Daniel M. Yasich
*Attorney, Agent, or Firm*—Joel Halpern

[57] ABSTRACT

An inventory control board includes a housing in which a series of front-to-rear spaced transparent sections are provided. A series of slots are formed in the housing beneath the transparent sections, and a series of shafts corresponding in number to the number of slots are rotatably mounted in the housing each such shaft being laterally spaced from and in alignment with one of the slots. Each shaft carries a pair of drums for rotation therewith, and windows are located in the housing above each of the drums to afford visual access to indicia carried by the drums.

2 Claims, 3 Drawing Figures

INVENTORY CONTROL BOARD

BACKGROUND OF THE INVENTION

The present invention relates to an inventory control board and more particularly to such a board which can be carried or hung on a wall.

The value of inventory control has achieved wide recognition in recent years, partially because of the many forms of inventory control systems and machines which have been made available. However, many of such systems and machines rely, at least in part, upon the use of electronic components. Although these systems and machines are accurate, provide instantaneous information, and are extremely versatile they are relatively expensive and are subject to mechanical and electronic breakdown. The small shop owner, therefore, is generally precluded from using these systems and machines.

There is need, therefore, for a simple, manually operable inventory board which can be easily manipulated to provide a running indication of units sold and units still available.

The use of a board or panel to provide various types of information which can be manually changed to reflect current information is known. For example, U.S. Pat. No. 1,912,418 issued June 6, 1933 to P. Vehling et al. discloses a service indicator in which a plurality of rollers having thumbwheels attached thereto are utilized to provide an indication of various types of room services required by hotel guests. The rollers, however, are operable individually and the overall structural arrangement is such that it is not possible to correlate related information by means of a single thumbwheel.

SUMMARY OF THE INVENTION

It is one object of the invention to provide an inventory board which is simply constructed, requires no maintenance, and which affords visual inventory records of a series of selected articles which can be readily adjusted.

It is another object of the invention to provide an inventory board whereby manipulation of a single manual control controls multiple counters and affords an indication of units sold and units still in stock.

Other objects and advantages of the invention will become readily apparent from the following description of the invention.

According to the present invention there is provided an inventory control board comprising:

a housing having top, bottom, front, rear and side walls, a portion of said top wall adjacent one of said side walls being provided with a series of transparent sections which are in spaced relation between said front and rear walls;

a plurality of slots formed in said housing beneath said transparent sections, each of said slots being open at said one side wall and extending inwardly of the housing therefrom to respectively receive indicia-bearing cards;

a plurality of shafts rotatably mounted in said housing, each of said shafts being spaced laterally from and in longitudinally aligned relation with a different one of said slots;

a plurality of indicia-bearing drums carried by each of said shafts;

and a thumbwheel associated with each of said shafts for selectively rotating same.

BRIEF DESCRIPTION OF THE DRAWINGS p In order that the invention may be more fully understood it will now be described, by way of example, with reference to the accompanying drawings in which.

DETAILED DESCRIPTION OF THE INVENTION

Figure 1:
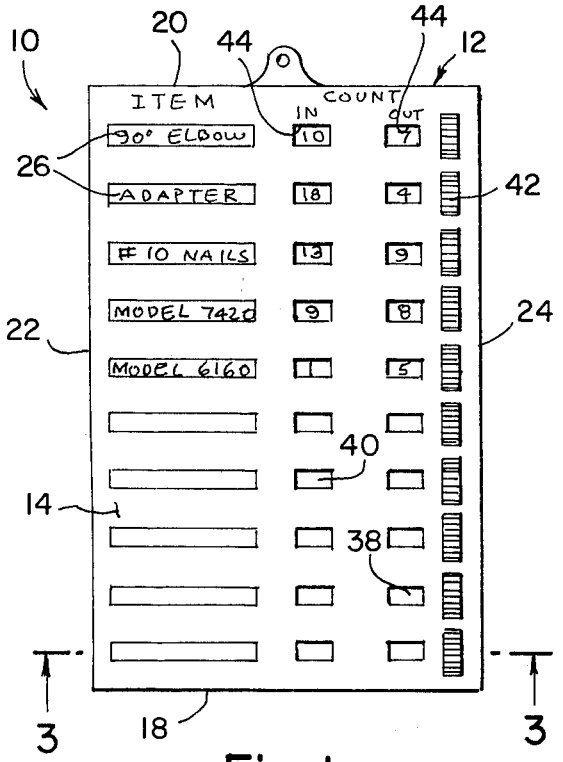
FIG. 1 is a front view of an inventory board embodying the features of the invention.
Figure 2:
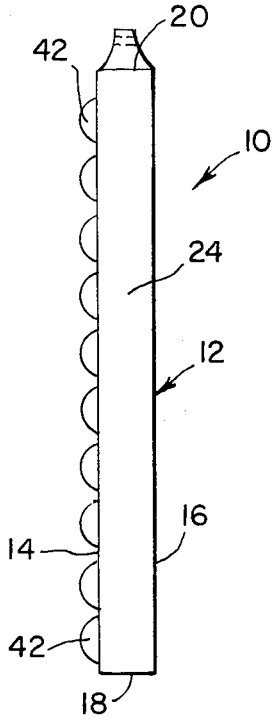
FIG. 2 is a side elevational view of the inventory board shown in FIG. 1.
Figure 3:
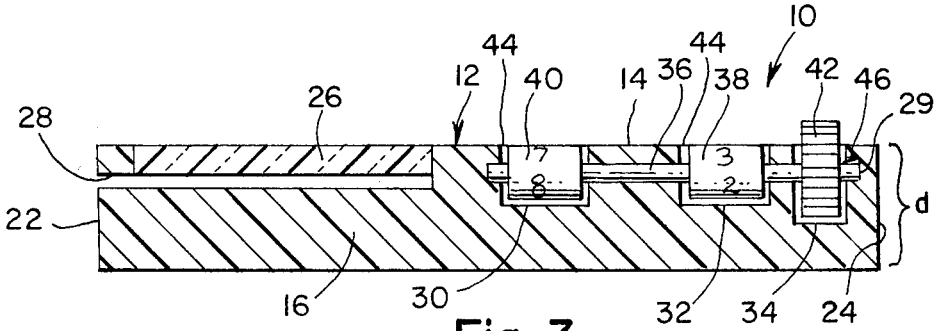
FIG. 3 is a front elevational view, partly in cross-section, of the inventory board shown in FIG. 1 taken along line 3—3 thereof.

Referring to the drawings there is shown an inventory board identified generally by reference numeral 10. The board includes a housing 12 having top 14, bottom 16, front 18, rear 20 and side walls 22, 24. The housing is desirably of rectangular shape as shown in FIG. 1 and is given a thickness *d* sufficient to accommodate the shaft and drum arrangement to be described. The thickness, therefore, is not unduly great and enables the board to be employed as a clipboard or to be hung upon a wall for viewing.

The housing is provided adjacent one of the side walls, preferably the left side wall, with a series of transparent sections 26 which are in spaced relation to each other and extend between the front and rear walls 18, 20 of the housing. In accordance with a preferred embodiment of the invention the sections 26 are cut out of the housing and given a clear plastics window.

Beneath each of the transparent sections a slot 28 is formed in the housing which is open at the adjacent side wall and extends inwardly of the housing. The slots are dimensioned so as to be able to receive a card bearing certain information. For example, the card can contain indicia identifying a particular sales item or article carried in stock.

The housing, which may be formed of a molded thermoplastics material, is provided with a longitudinally extending bore 29 and several series of recesses 30, 32, 34 each of which series is adapted to rotatably mount a shaft 36 and at least two drums 38, 40 thereon. Each of the series of recesses is formed in the housing so as to mount the shafts and drums in spaced lateral and aligned relation to one of slots 28. The drums on each shaft are provided with indicia, desirably sequences of numbers. Thus, drum 38 of each series may carry a set of numerals which appear in decreasing sequential order when the shaft 36 is rotated in a clockwise direction when the board is viewed from the right side as shown in FIG. 1. Drum 40, on the other hand, is provided with a set of numerals which appear in increasing sequential order when the board is viewed from the same direction. Each of the shafts is provided with a thumbwheel 42 for selectively rotating the shaft and the drums carried thereon. The thumbwheels are desirably of greater diameter than the drums 38, 40 so as to extend above the top wall of the housing to facilitate manipulation.

The housing is provided in the top wall thereof with a plurality of window openings 44 at locations coinciding with the drums 38, 40 such that the numerals carried by the drums are readily visible.

In order to prevent inadvertant rotation of the shafts each is given a spring detent 46 which bears against the overlying surface of the housing and frictionally prevents such accidental shaft rotation.

It will be thus clearly understood that the drum 38 is provided with a numerical indication of the quantity of units of a particular sales item or article carried in the stock of the store. As sales proceed, and the number of units in stock serially decrease, the thumbwheel is turned so as to rotate the shaft. Drum 38 will display the next succeeding lower number whereas drum 40 will display the next succeeding higher number. Drum 38 thus indicates the number of units left in stock whereas drum 40, beginning with the numeral zero, indicates the aggregate number of units which have been sold. Each turn of the thumbwheel, upon completion of the sale of an article listed in the associated slot, brings the inventory board current on the number of units sold and on the number of units remaining in stock.

Since the construction is simple and the board relatively thin it is possible to carry the board around or to hang it in the store within easy reach of the sales personnel and where it is readily available to provide an ongoing status report.

From the foregoing it will be seen that a relatively inexpensive inventory control board has been provided which can be easily purchased and used by proprietors of small shops where a quick, reliable and inexpensive means of maintaining inventory control is needed.

I claim:

1. An inventory control board comprising:

a housing having top, bottom, front, rear and side walls, a portion of said top wall adjacent one of said side walls being provided with a series of transparent sections which are in spaced relation between said front and rear walls;

a plurality of slots formed in one of the side walls of said housing beneath each one of said transparent sections, each of said slots being open at said one side wall and extending inwardly of the housing therefrom to respectively receive indicia-bearing cards visually inspectable through said transparent sections;

a plurality of shafts rotatably mounted in said housing, each of said shafts being spaced laterally from and in longitudinally aligned relation with a different one of said slots;

a plurality of indicia-bearing drums carried by each of said shafts;

a series of windows formed in the top wall of said housing located respectively above said drums so as to provide visual access to the indicia carried thereon;

a thumbwheel carried by each of said shafts for selectively rotating same;

and a spring detent carried by each said shaft adapted to prevent inadvertant rotation thereof.

2. An inventory control board according to claim 1, wherein said drums consist of a pair of longitudinally spaced drums carried by each of said shafts.

* * * * *